US005542381A

United States Patent [19]

Noda et al.

[11] Patent Number: 5,542,381

[45] Date of Patent: Aug. 6, 1996

[54] CYLINDER BLOCK FOR LIQUID-COOLED ENGINE

[75] Inventors: Yasushi Noda; Tsuyoshi Masuda; Yutaka Matayoshi, all of Yokosuka, Japan

[73] Assignee: Nissan Motor Co., Ltd., Yokohama, Japan

[21] Appl. No.: 382,788

[22] Filed: Feb. 2, 1995

[30] Foreign Application Priority Data

Feb. 7, 1994 [JP] Japan ..... 6-013664

[51] Int. Cl.[6] ..... F02B 75/18

[52] U.S. Cl. ..... 123/41.74; 123/41.79

[58] Field of Search ..... 123/41.74, 41.79

[56] References Cited

FOREIGN PATENT DOCUMENTS 4-136461 5/1992 Japan .

*Primary Examiner*—Noah P. Kamen

*Attorney, Agent, or Firm*—Foley & Lardner

[57] ABSTRACT

A liquid-cooled engine cylinder block wherein a plurality of cylinder walls forming cylindrical cylinders are arranged in series. The adjacent cylinder walls are joined together, and the outer circumference of these cylinder walls is covered by a water jacket wall. A passage for cooling liquid is formed between the water jacket wall and the cylinder walls in a direction perpendicular to the axes of cylinders. A guide rib is provided in the passage adjacent to the outer circumference of the cylinder walls so as to vertically divide the flow of cooling liquid. The guide rib comprises two guide members, one of which is inclined in an upward direction and the other inclined in a downward direction from their respective upstream ends. The cooling liquid in the passage is separated into upper and lower flows by the guide rib, and these flows combine a hollow area of the cylinder walls at the side of the cylinder joining member at the downstream of the guide rib. This arrangement increases the flowrate of cooling fluid in the hollow areas, and prevents the temperature of the joining members from rising above that of other parts of the cylinder block.

7 Claims, 15 Drawing Sheets

CYLINDER BLOCK FOR LIQUID-COOLED ENGINE

FIELD OF THE INVENTION

This invention relates to a cylinder block for a liquid-cooled engine, and more particularly, to the circulation of a cooling liquid in a cylinder block.

BACKGROUND OF THE INVENTION

Liquid-cooled multi-cylinder engines are generally cooled by forming a water jacket outside the cylinder walls forming the cylinder, and circulating a cooling liquid through a cooling passage formed between these walls.

In a particular cylinder block known as a Siamese cylinder block, the cylindrical engine cylinders are separated by a short interval, and the adjacent cylinder walls are joined together, so hollow areas are formed in the cooling passage at the sides of the joining members.

A horizontal section of the cooling liquid circulation passage therefore appears as a plurality of arcs formed by the bulge of the cylinders, these arcs being joined by the hollow areas. At the points where these hollow areas are situated, the cooling liquid passage is bent at a sharp angle. Because these bends obstruct the smooth flow of cooling liquid, an undesirable amount of heat is produced. FIGS. 16*a* and 16*b* show the distribution of the cooling liquid flowrate and the distribution of the rate of heat transmission under these conditions. It is seen that where the hollow areas 6 are located, both the flowrate of the cooling liquid, and the heat transmission rate are reduced.

Tokkai Hei 4-136461 published by the Japanese Patent Office in 1992 proposes decreasing the width of the water jacket midway along its length so as to increase the flowrate of cooling liquid through the hollow areas.

However, in this case, the cross-sectional area of the water jacket varies sharply, causing increased resistance to fluid flow and increased load on the water pump circulating the cooling liquid.

Moreover, as the cylinder block is generally of cast iron construction, the thickness of the insert used for forming the passage during the casting process becomes smaller at points where the cross-section of the passage undergoes a large variation. Thus, the strength of the insert tends to be insufficient, and renders casting difficult.

SUMMARY OF THE INVENTION

It is therefore a primary object of this invention to improve cylinder cooling performance without making significant changes to the passage cross-sectional area.

In order to achieve the above object, this invention provides a liquid-cooled engine cylinder block comprising a plurality of cylinders arranged in series. The cylinders are formed by cylinder walls wherein adjacent cylinder walls are joined together. The engine cylinder block further includes a water jacket formed by a water jacket wall which covers the outer circumference of the cylinder walls such that a passage for cooling liquid is formed by the water jacket wall and the cylinder walls in the direction perpendicular to the axes of the cylinders. The cylinder block further includes at least one guide rib provided effectively at the side of the center of a cylinder (that is, adjacent to the outer circumference of the cylinder walls) and inside the passage so as to vertically separate the flow of cooling liquid. The guide rib comprises two guide members extending in respective upward and downward directions (that is, one of which inclines upward at an angle and one of which inclines downward at an angle) from the upstream end of the guide rib. The guide members are located in a substantially central position with respect to the vertical width of the passage.

According to an aspect of this invention, the guide rib has a "V" shape wherein the apex is formed by the upstream ends of the guide members.

According to another aspect of this invention, the guide rib has an arc shape wherein the center of the arc is formed by the upstream ends of the guide members.

According to yet another aspect of this invention, the guide rib is formed in a one-piece construction with the water jacket wall, and a gap exists between the guide rib and the cylinder wall.

According to yet another aspect of this invention, an opening through which cooling fluid can pass is provided between the upstream ends of the guide members.

According to yet another aspect of this invention, each of the guide members is curved or bent into a bow shape in the upward and downward directions wherein one guide member extends in an upward direction and the other guide member extends in a downward direction.

According to yet another aspect of this invention, the cylinder block is formed by casting, a slag hole is provided in the water jacket wall, and the guide rib is of unitary (that is, formed in a one-piece) construction with a plug sealing the hole.

The details as well as other features and advantages of this invention are set forth in the remainder of the specification and are shown in the accompanying drawings.

BRIEF DESCRIPTION OF THE INVENTION

Figure 5A:
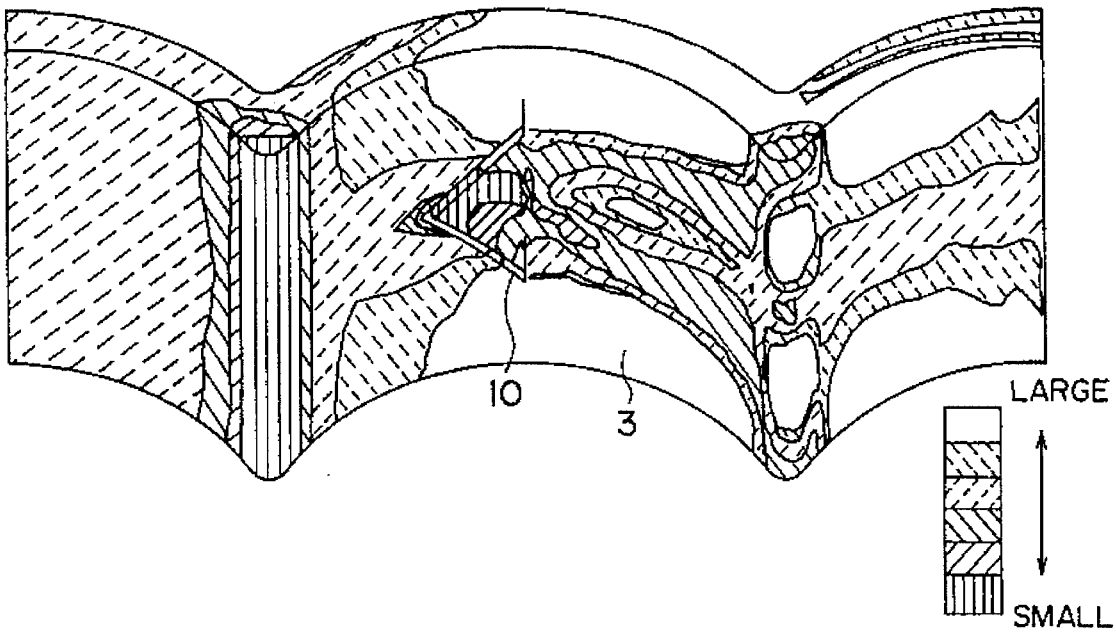

FIGS. 5*a, b* are schematic perspectives views of a part of a cooling liquid passage according to this invention, showing the flowrate distribution and heat transmission of the cooling liquid.

Figure 6A:
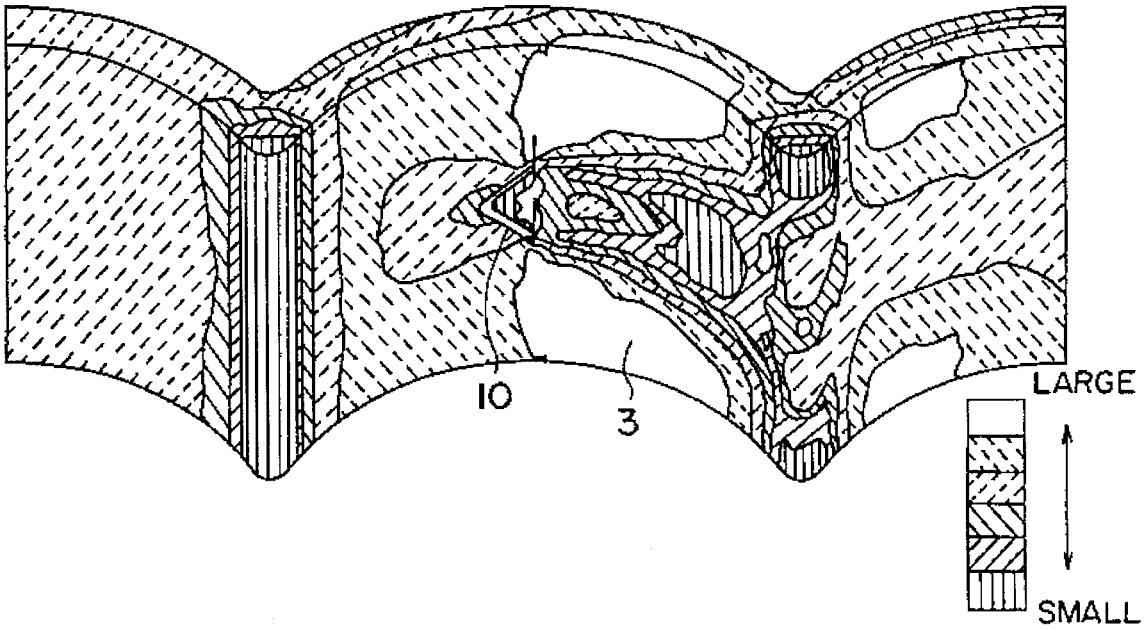

FIGS. 6*a, b* are similar to FIGS. 5*a, b*, but showing flowrate distribution and heat transmission rate distribution of the cooling liquid when a smaller guide rib is used.

Figure 7A:
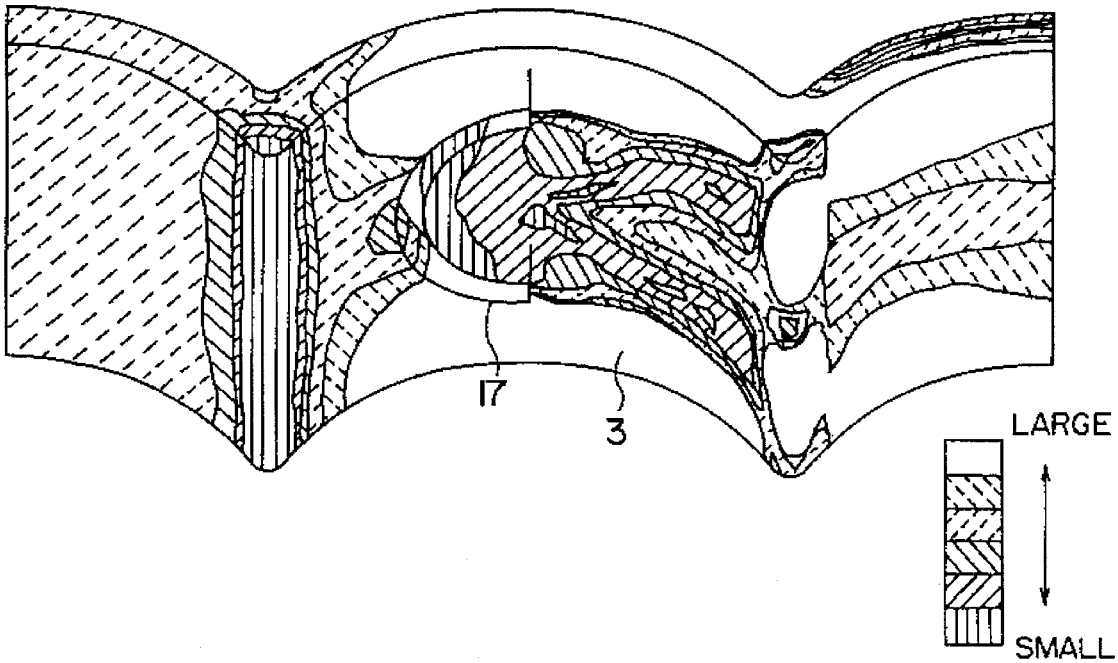

FIGS. 7*a, b* are similar to FIGS. 5*a, b*, but showing the flowrate distribution and heat transmission rate distribution of the cooling liquid with an arc shaped guide rib according to a second embodiment of this invention.

Figure 8:
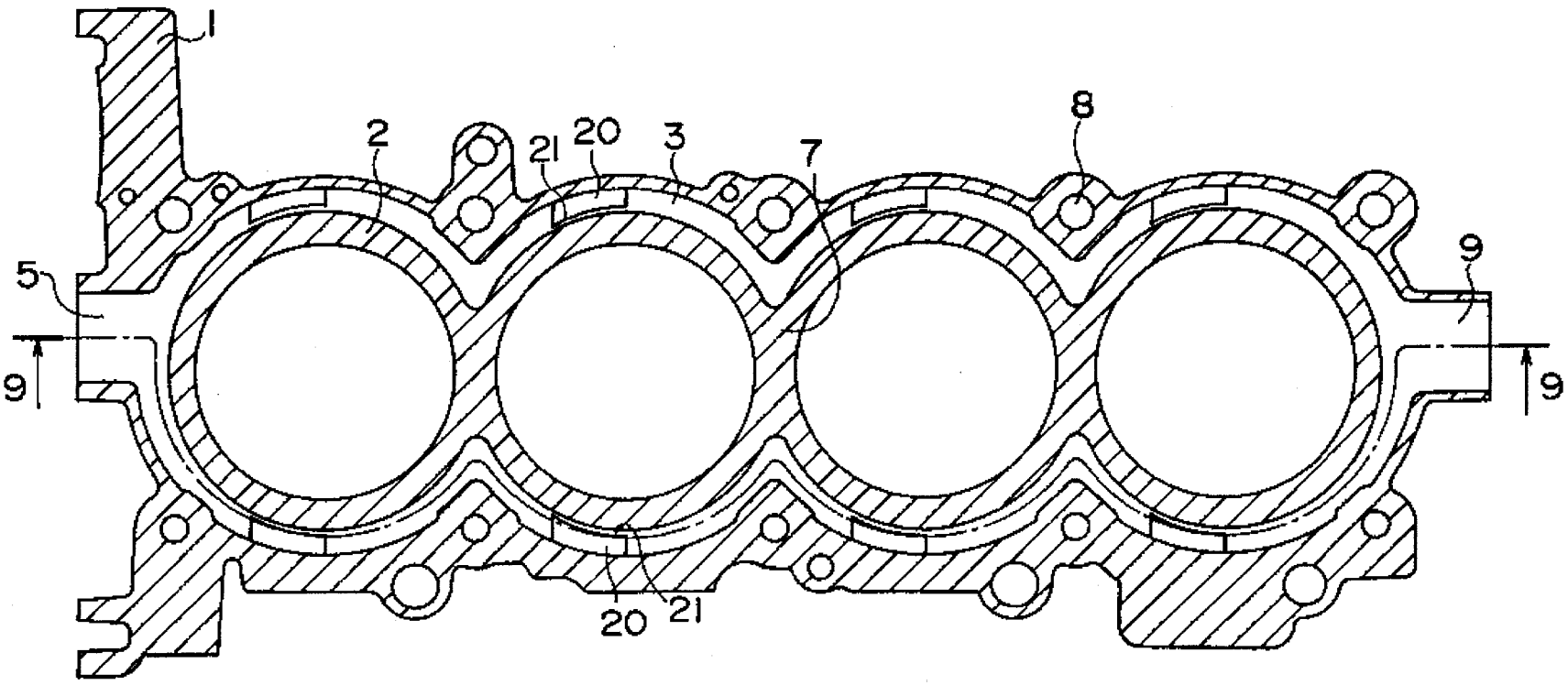

FIG. 8 is a horizontal sectional view of a cylinder block according to a third embodiment of this invention.

Figure 9:
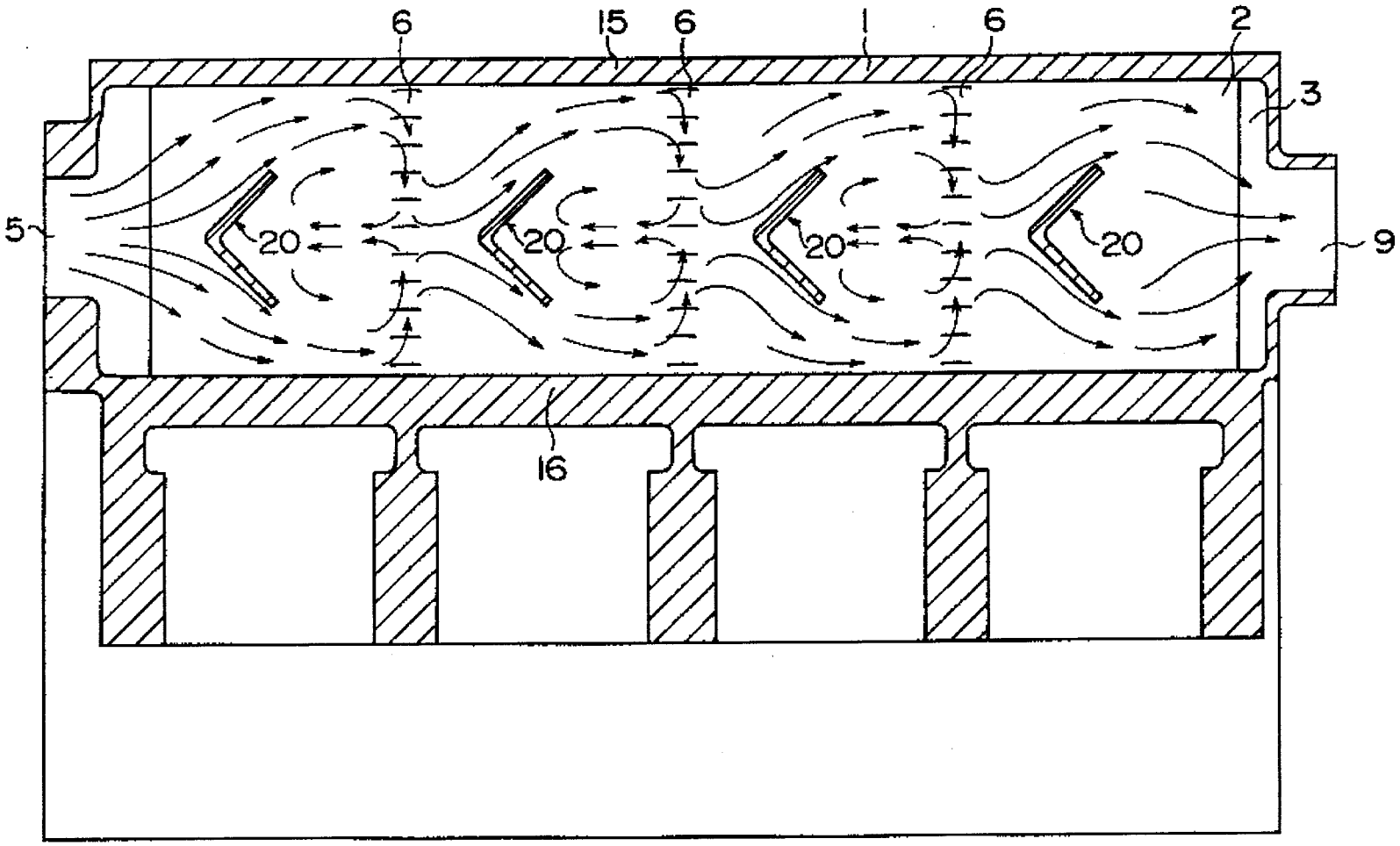

FIG. 9 is a sectional view of the cylinder block taken along a line 9—9 of FIG. 8.

Figure 10:
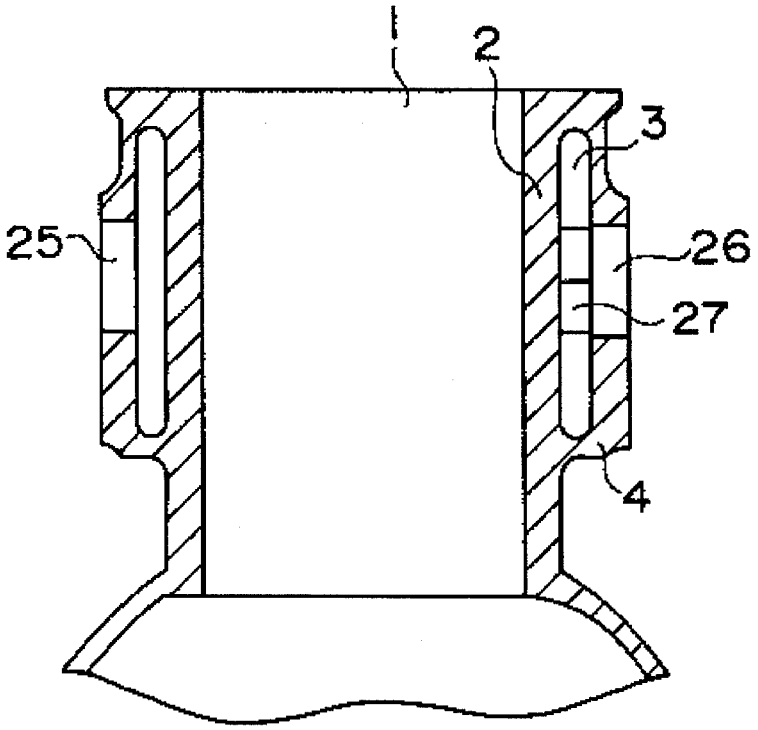

FIG. 10 is a sectional view of a cylinder block according to a fourth embodiment of this invention.

Figure 11:
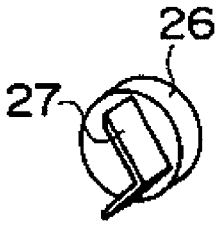

FIG. 11 is a perspective view of a plug and guide rib according to a fourth embodiment of this invention.

Figure 12:
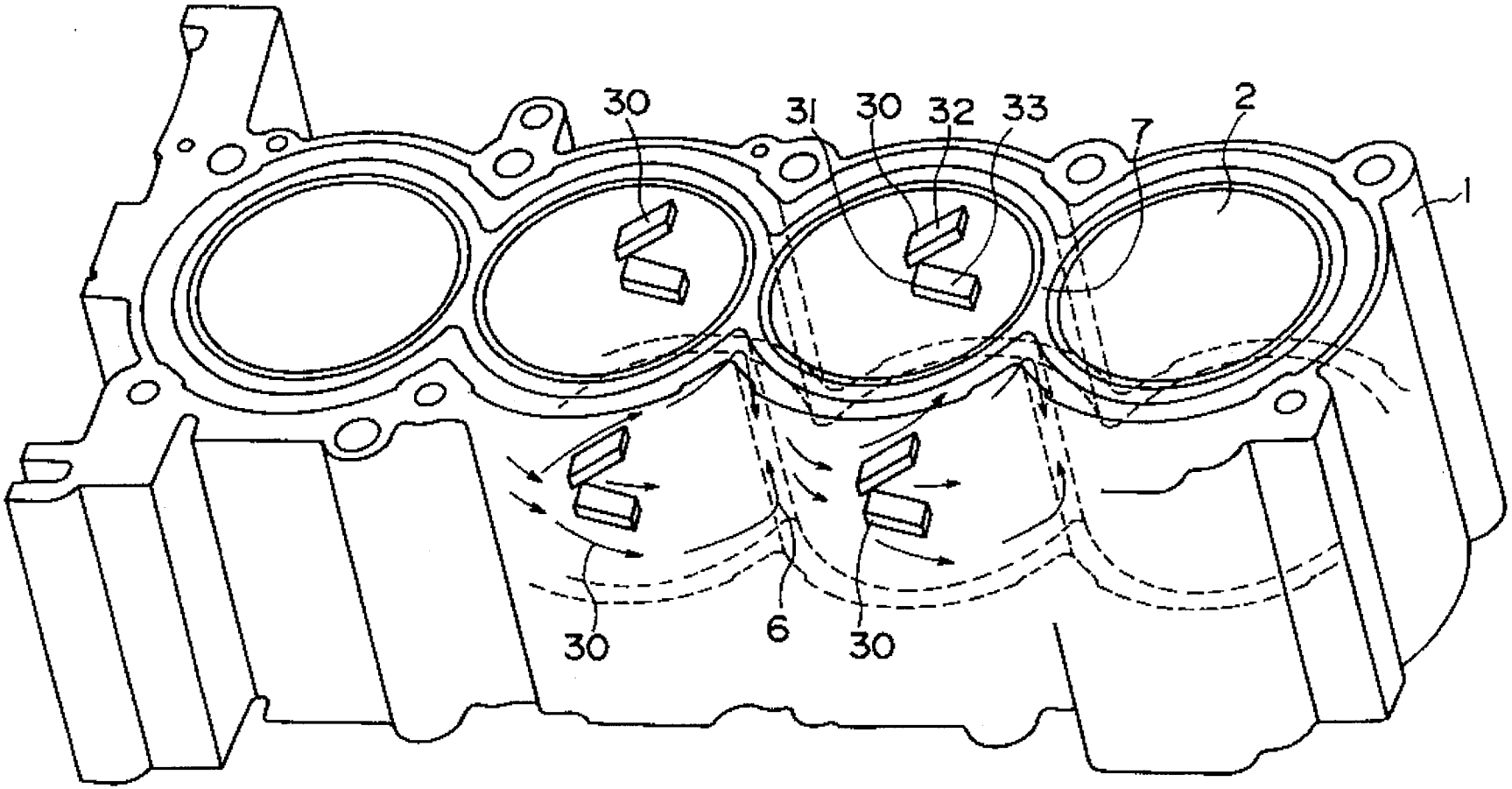

FIG. 12 is a perspective view of a cylinder block according to a fifth embodiment of this invention.

Figure 13:
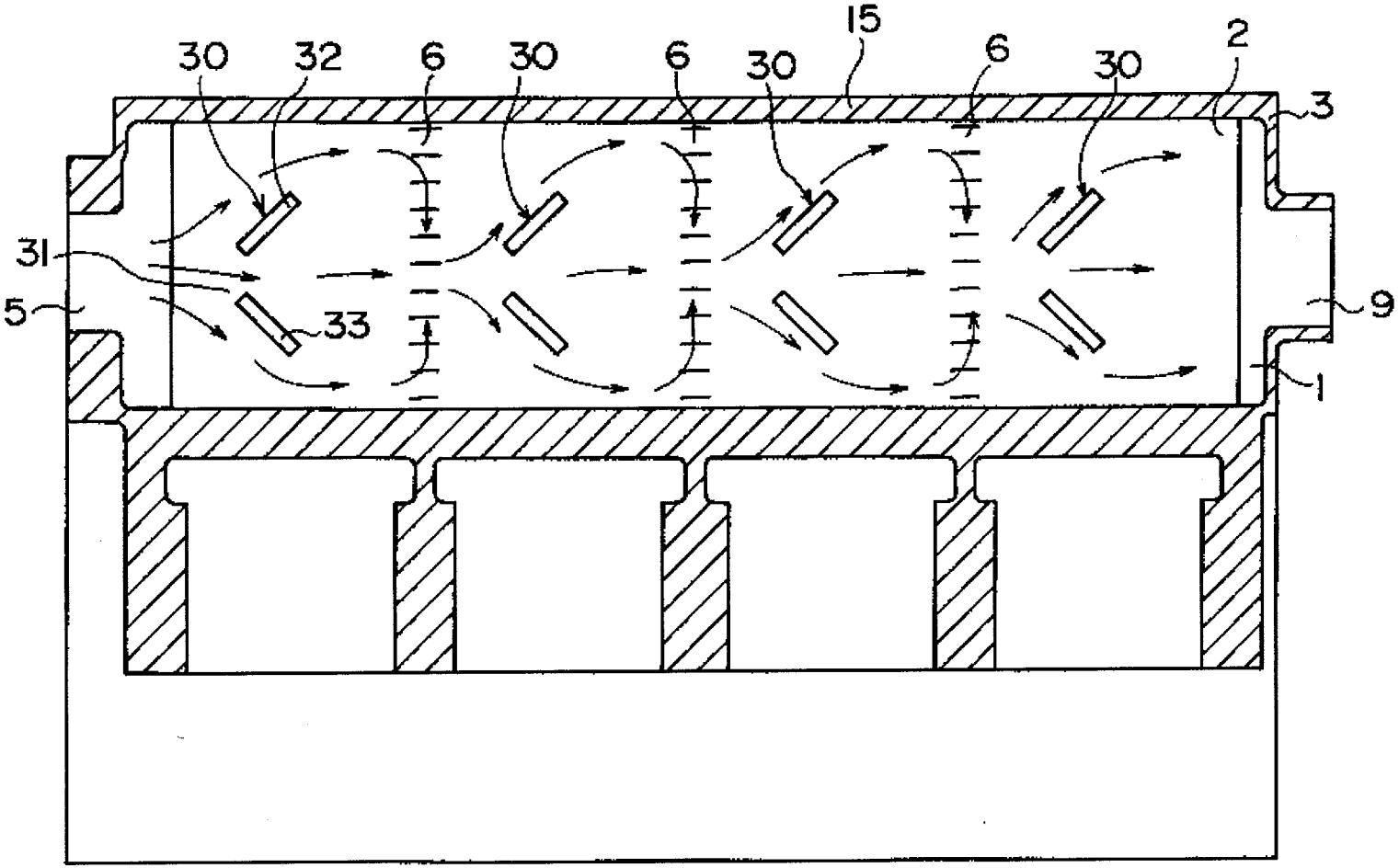

FIG. 13 is a vertical sectional view of the cylinder block.

Figure 14:
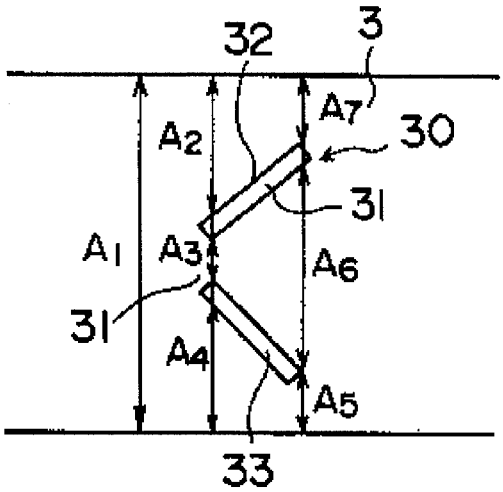

FIG. 14 is a side view of a guide rib according to a fifth embodiment of this invention.

Figure 15:
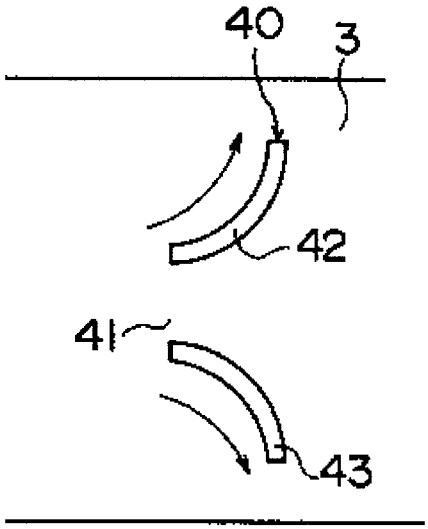

FIG. 15 is a side view of a guide rib according to a sixth embodiment of this invention.

Figure 16A:
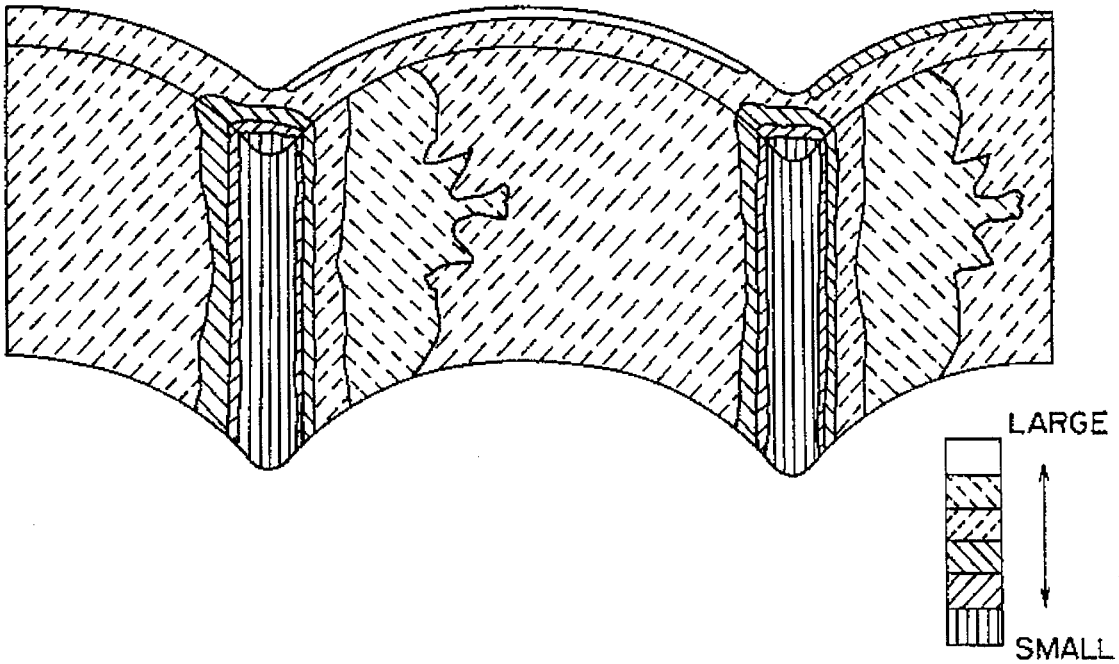
Figure 16B:
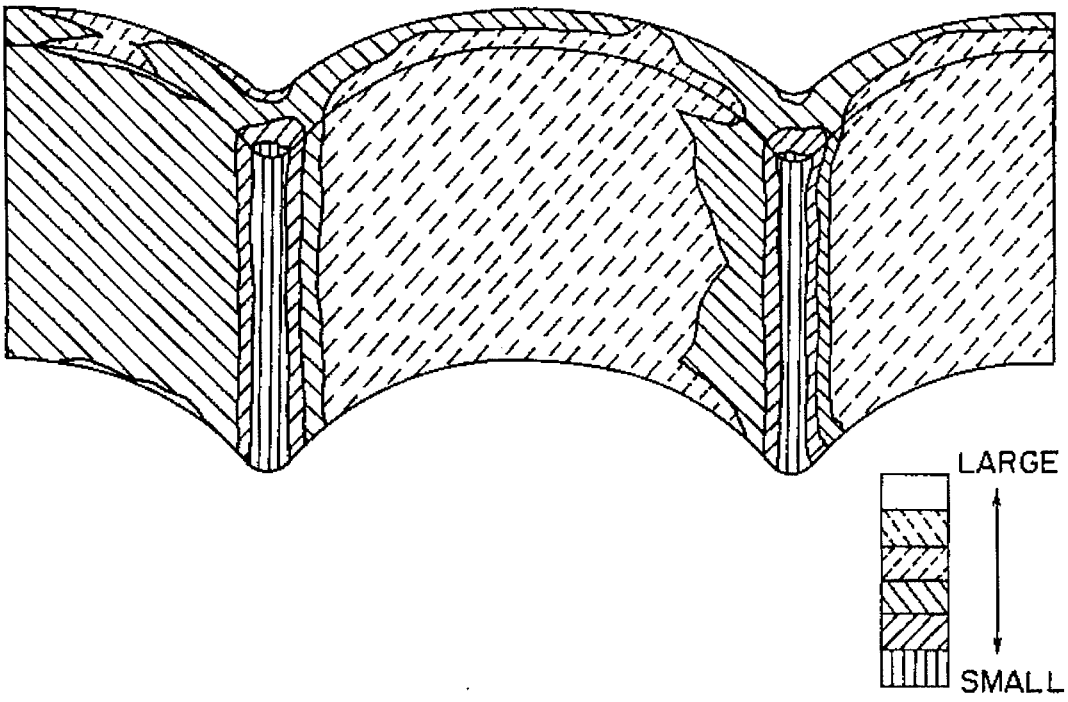

FIGS. 16*a, b* are schematic perspectives views of a part of a conventional cooling fluid passage showing the flowrate distribution and heat transmission rate distribution of the cooling liquid.

Figure 17A:
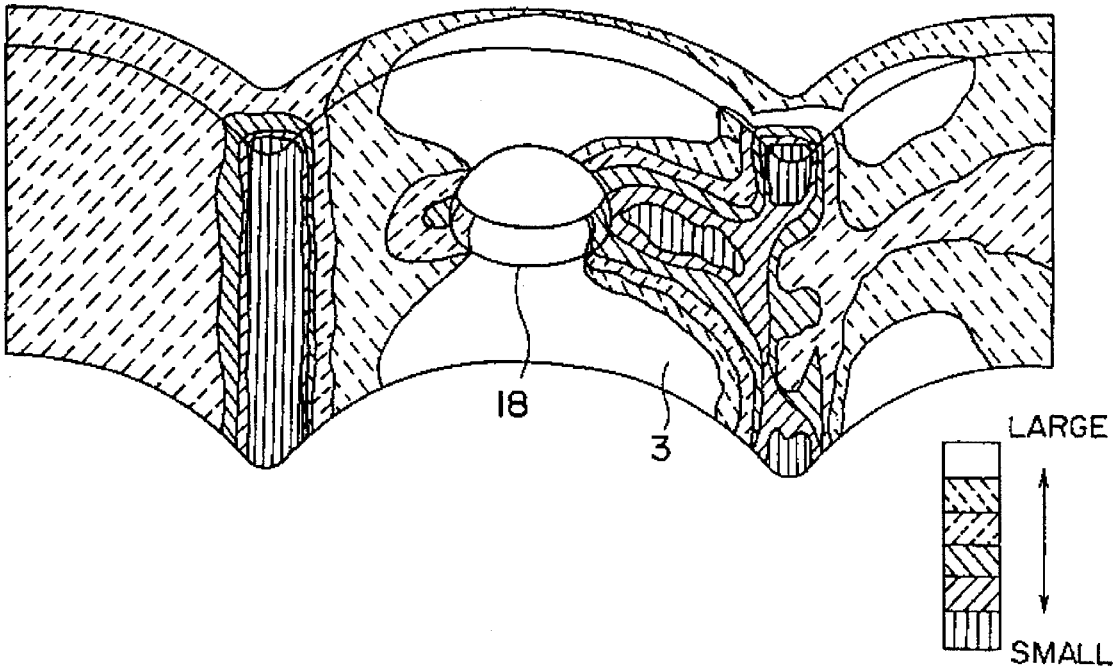

FIGS. 17*a, b* are schematic perspectives views of a part of another conventional cooling fluid passage showing the flowrate distribution and heat transmission rate distribution of the cooling liquid.

DESCRIPTION OF THE PREFERRED EMBODIMENTS

Figure 2:
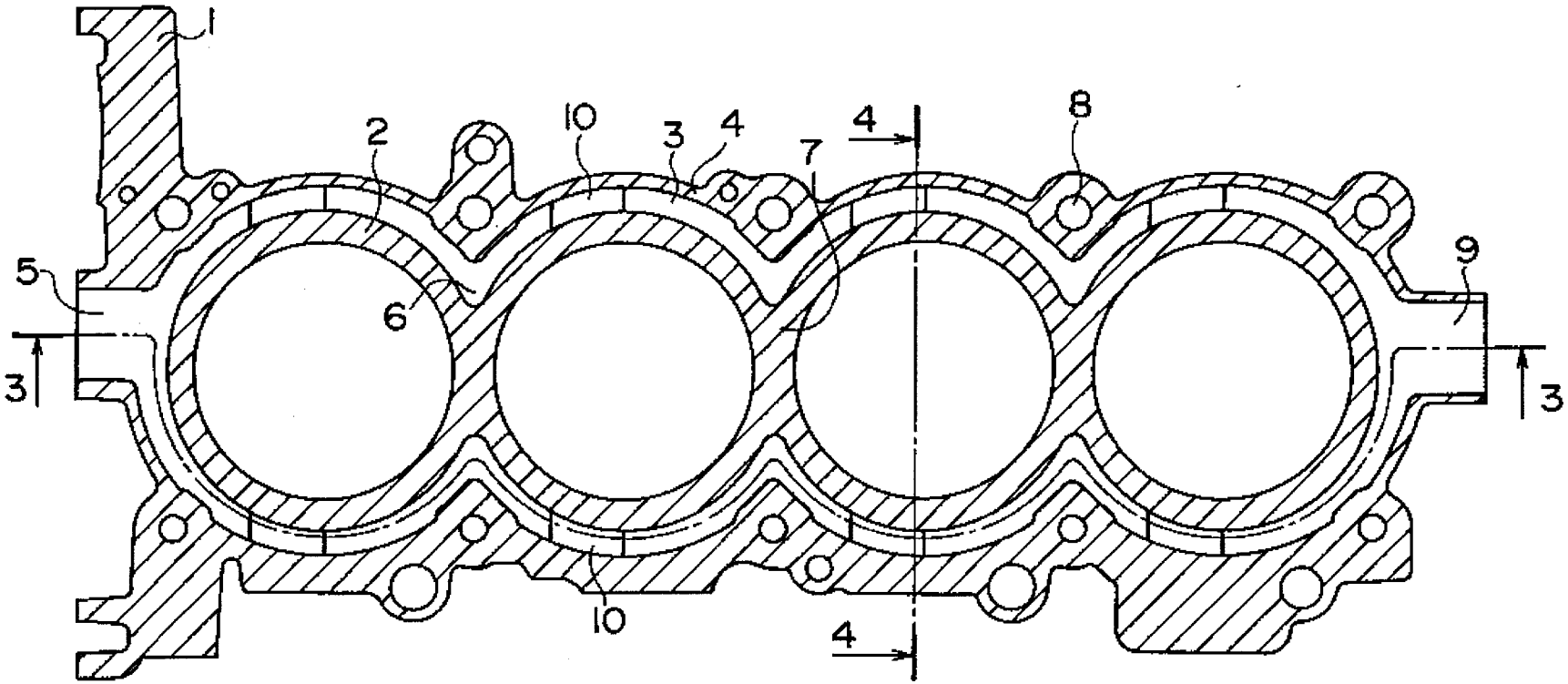
FIG. 2 is a horizontal cross sectional view of the cylinder block.

Referring to FIG. 2 of the drawings, a cylinder block 1 is provided with four cylinders arranged in series and spaced at short intervals from one another. A cylinder wall 2 forming each cylinder has a cylindrical shape. In order to reduce the overall length as far as possible, the cylinder wall 2 of each cylinder is joined to the adjacent cylinder so as to form a Siamese type cylinder block. A hollow area 6, shaped in the form of a vertical groove, is formed outside a joining member 7 between each cylinder wall 2 and an adjacent cylinder wall 2.

The cylinder block 1 further includes a water jacket 3 that circulates a cooling liquid around each cylinder wall 2. The water jacket 3 has a wall 4 which is substantially parallel to the cylinder wall 2, with a passage for circulating cooling liquid being formed between the water jacket wall 4 and cylinder wall 2. The vertical section of this cooling liquid passage therefore takes the form of arcs due to the bulge of the cylinder walls 2 joined by the hollow areas 6.

Figure 1:
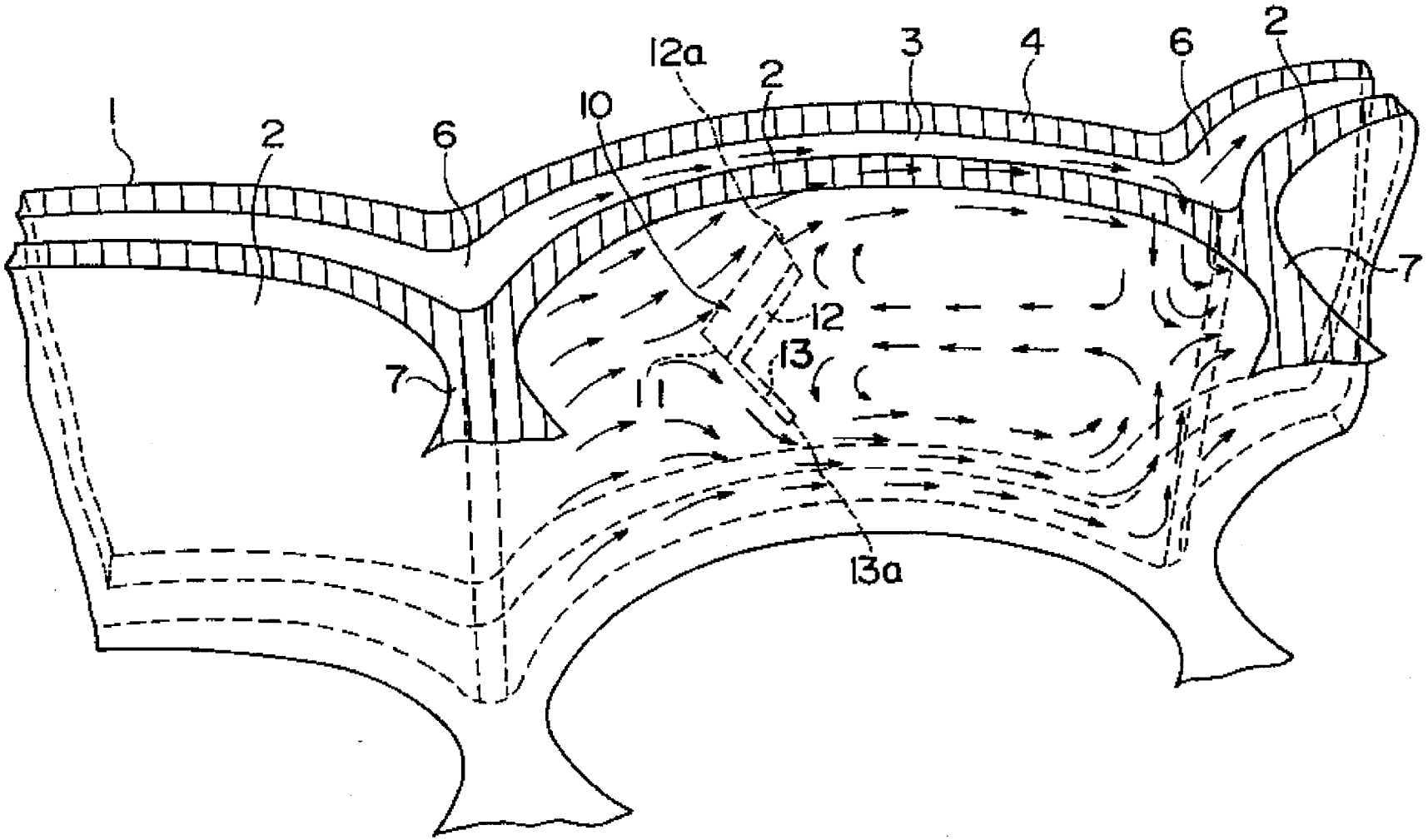
FIG. 1 is a perspective view of a part of a cylinder block according to this invention.
Figure 3:
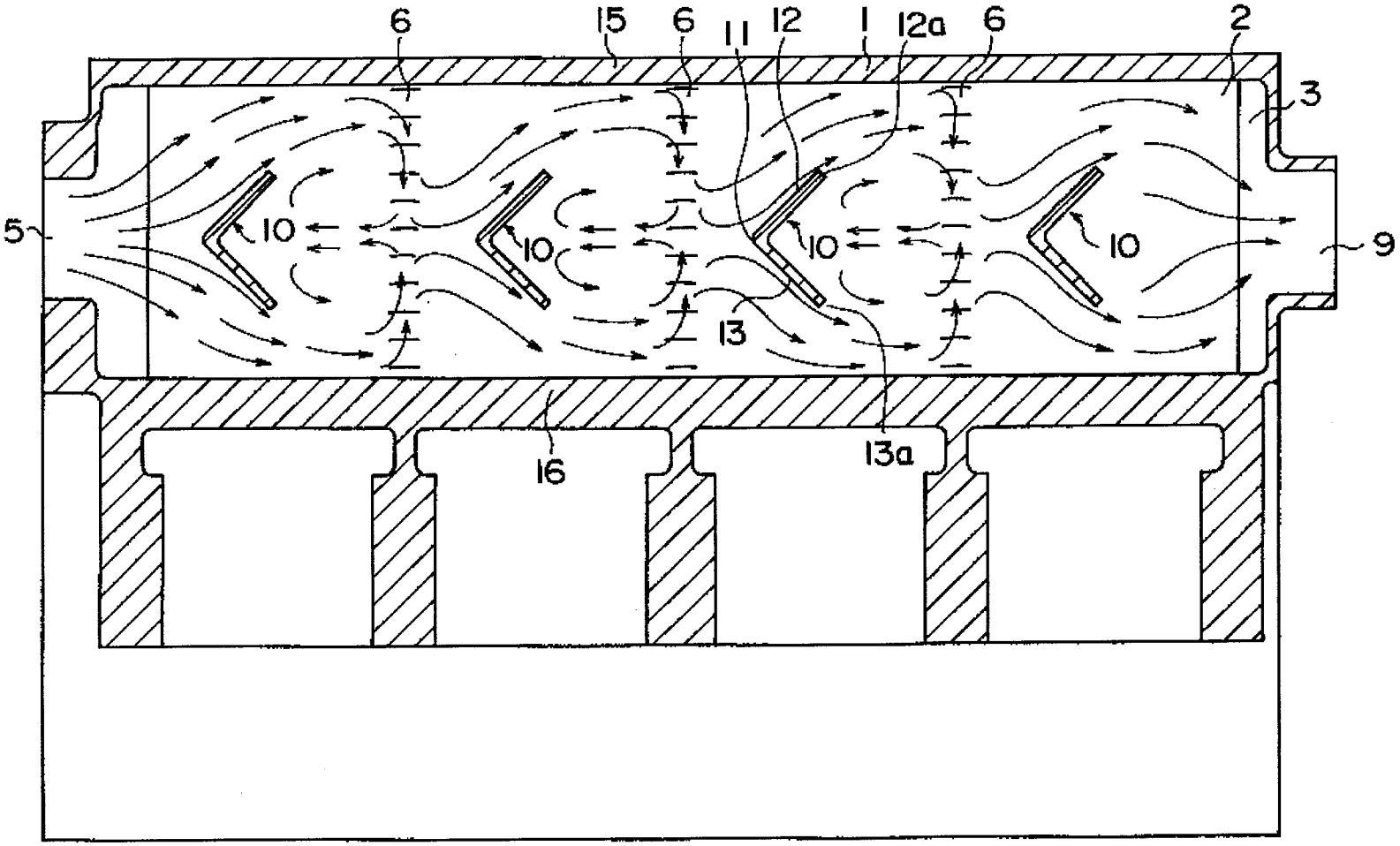
FIG. 3 is a sectional view of the cylinder block taken along a line 3—3 in FIG. 2.

The water jacket 3 further includes an inlet 5 and outlet 9 as shown in FIG. 3. Guide ribs 10, shown in FIG. 1, are provided inside the cooling liquid passage of the water jacket 3. The guide ribs 10 are situated beside the center part of the cylinder and have a V-shaped cross-section, the apex at which the two sides 12, 13 of the "V" meet constituting an upstream end 11, and the opposite ends of the two sides 12, 13 constituting downstream ends 12*a*, 13*a*. The guide ribs 10 are cast in a one-piece construction with the cylinder all 2 and the water jacket wall 4.

Cooling liquid from a water pump, not shown, flows into the water jacket 3 from the inlet 5. The cooling liquid is then discharged outside the cylinder block 1 from the outlet 9 via the passage between the cylinder wall 2 and water jacket wall 4, and is recirculated via a radiator, not shown.

As shown in FIGS. 1 and 3, the flow of cooling liquid in the water jacket 3 is divided into an upper part and a lower part by the guide ribs 10. The two flow parts combine in the vicinity of the hollow areas 6, and part of the flow forms a pair of whirlpools between the guide ribs 10 and the hollow areas 6.

FIG. 5*a* shows simulation data analyzing the flowrate of cooling liquid flowing in the water jacket 3. From the data, it is seen that the whirlpool flow set up in the cooling liquid by the guide ribs 10 increases the flowrate of the cooling liquid flowing in the hollow areas 6.

Figure 5B:
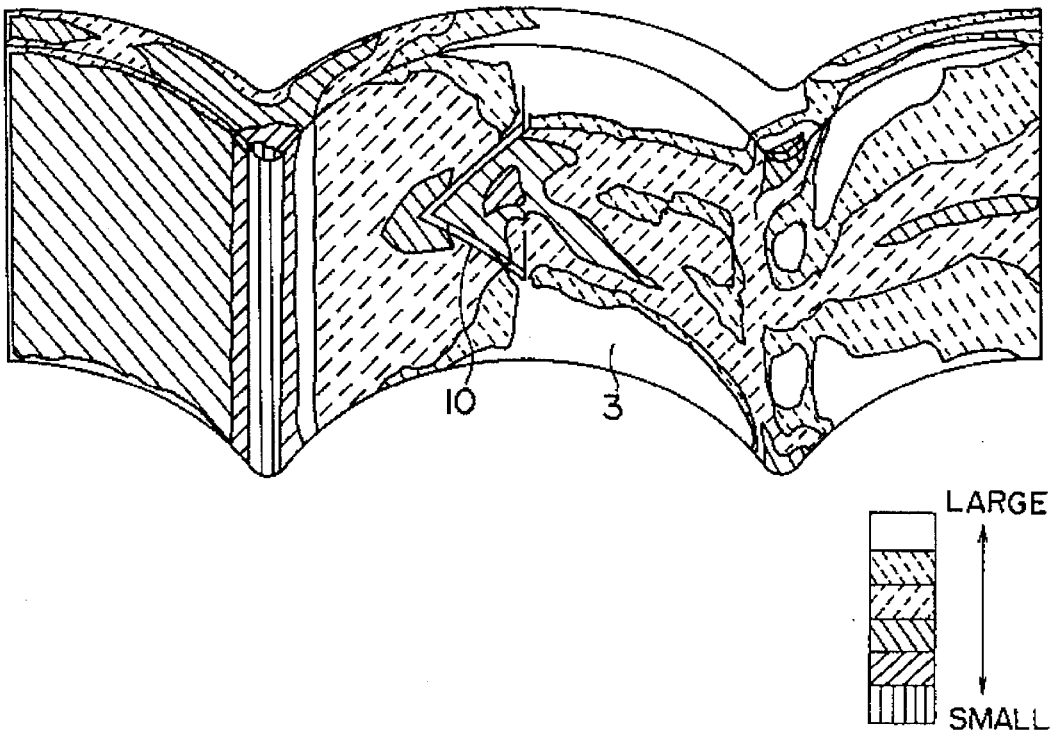

FIG. 5*b* shows simulation data analyzing the heat transmission rate inside the water jacket 3. From this data, it is seen that heat radiation from the hollow areas 6 to the cooling liquid is promoted by providing the guide ribs 10. This increase of radiated heat from the hollow areas 6 to the cooling liquid prevents the temperature of the joining members 7 of the cylinder walls 2 from rising above that of other parts, and renders the temperature distribution of the cylinder walls 2 uniform.

Figure 6B:
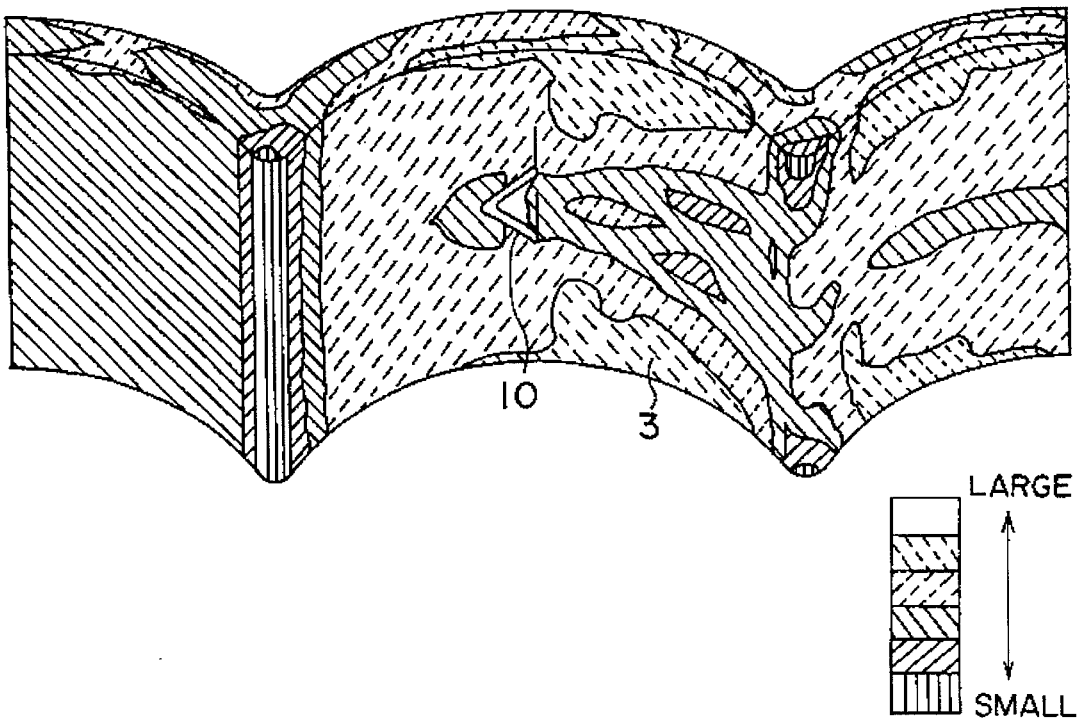

FIGS. 6*a* and 6*b* show simulation data analyzing flowrate and heat transmission rate when the guide ribs 10 are decreased in size. The data of FIGS. 6*a* and 6*b* shows that there is a tendency for the flowrate and heat transmission rate in the upper and lower parts of the hollow areas 6 to decrease due to the decreased size of the guide ribs 10.

Figure 4:
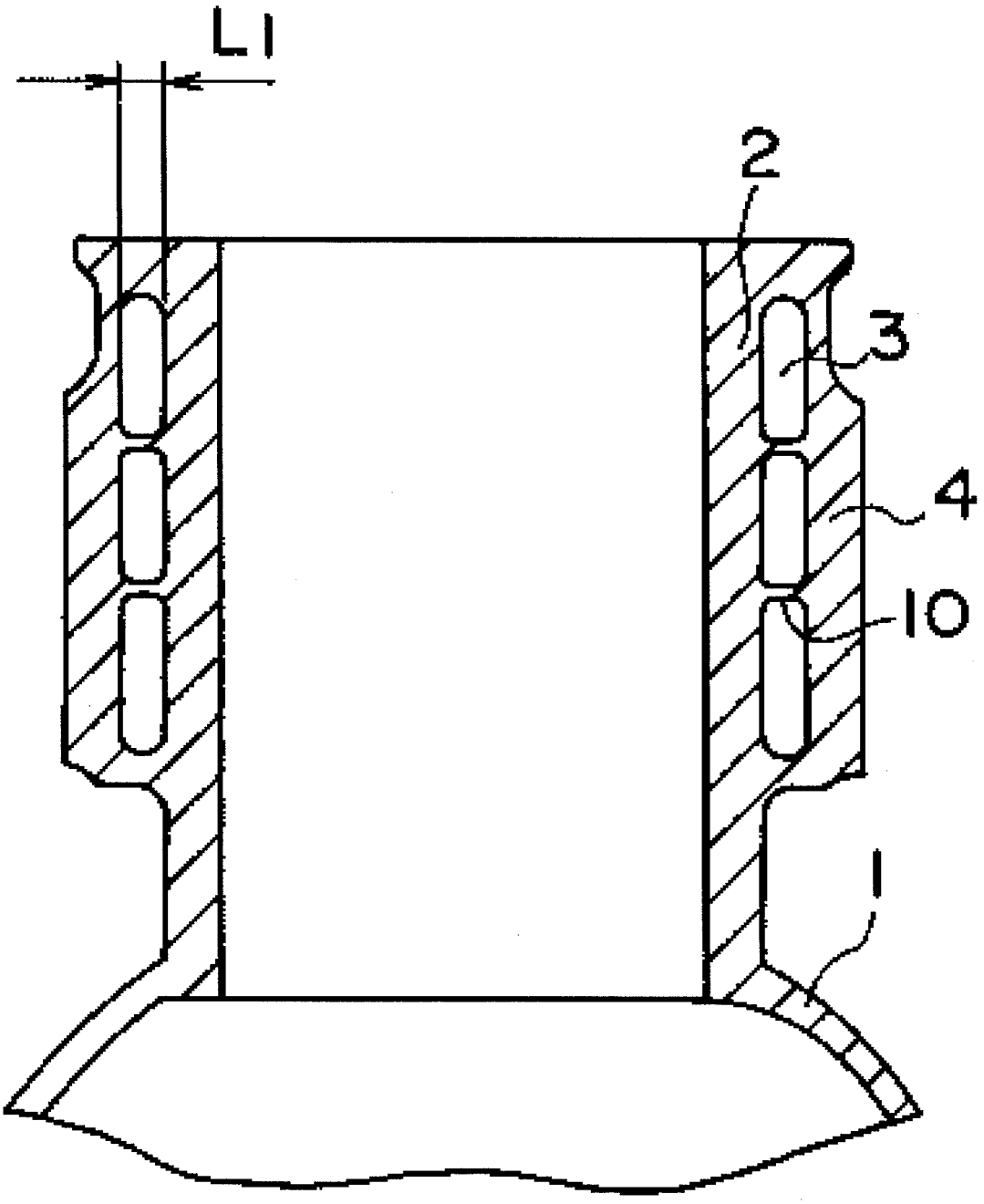
FIG. 4 is a sectional view of the cylinder block taken along a line 4—4 in FIG. 2.

In the cylinder block 1 according to this invention, the passage width $L_1$ of the water jacket 3 shown in FIG. 4 is not reduced midway along its length. Therefore, there is no increased resistance to flow, and accordingly no need to locally reduce the thickness of the insert forming the water jacket 3 during casting of the cylinder block. Hence, there is no concentration of stress on the insert during casting.

Figure 7B:
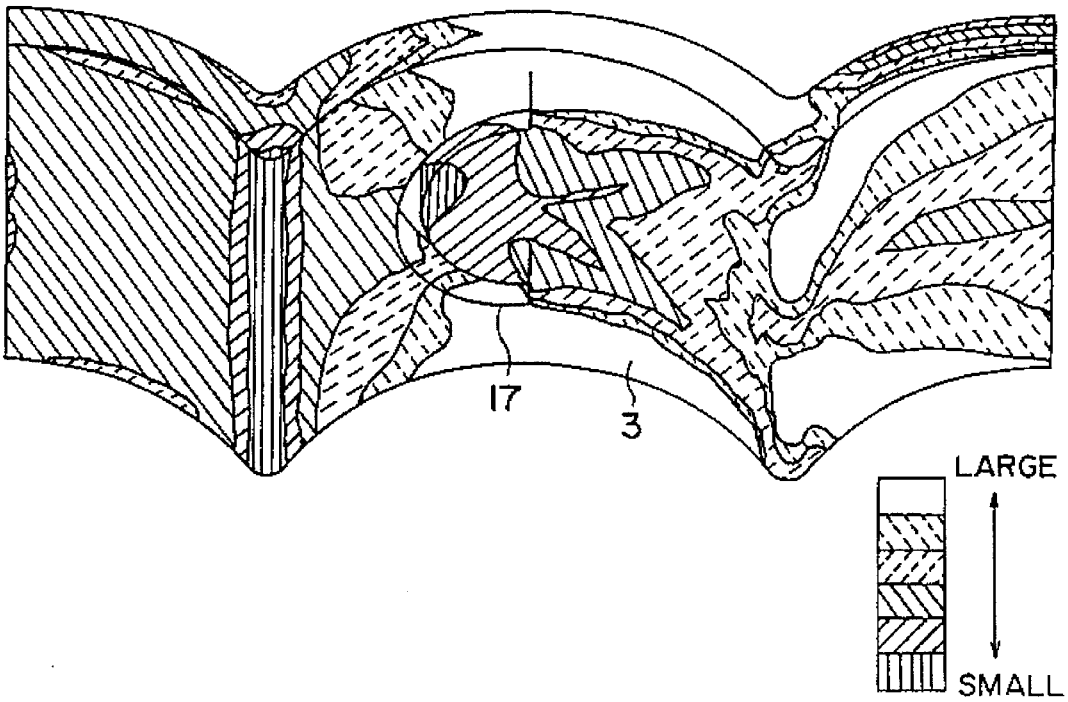

FIGS. 7*a* and 7*b* show a second embodiment of this invention using arc-shaped guide ribs 17. According to this embodiment a whirlpool flow is set up in the cooled liquid, and as the flowrate of cooled liquid in the hollow areas 6 is increased, heat radiation from the hollow areas 6 is promoted.

Figure 17B:
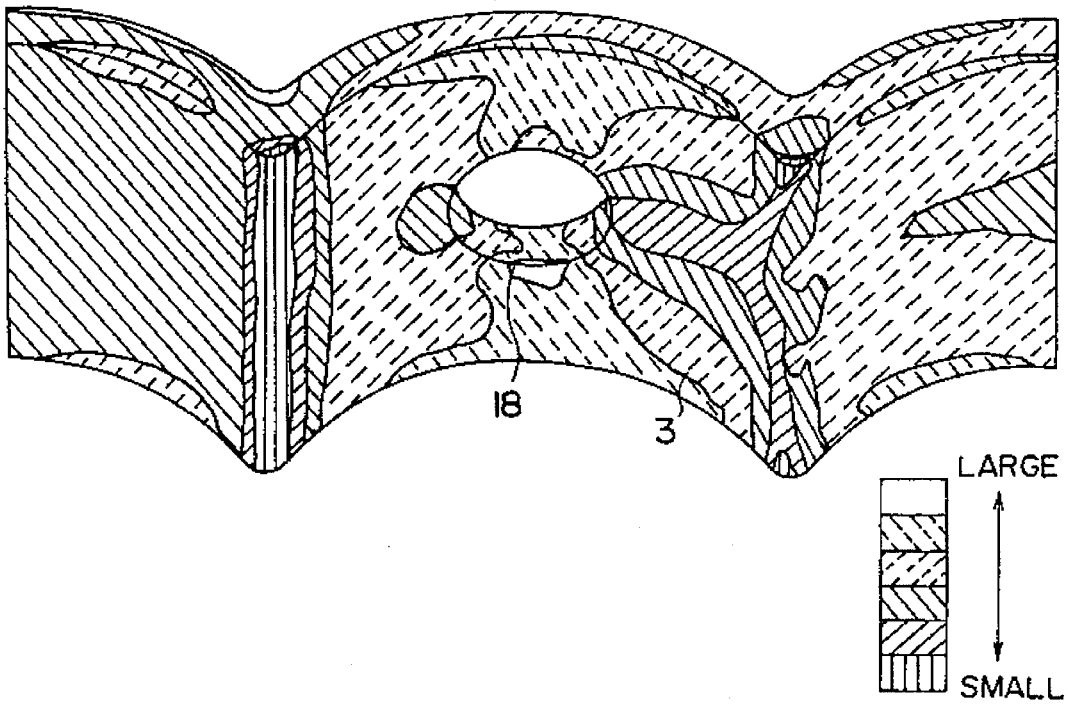

Unlike this invention, FIGS. 17*a* and 17*b* show simulation data analyzing the flowrate and the heat transmission rate for the guide ribs 18 which are formed in the shape of columns as taught by the prior art. In this case it is seen that as no whirlpool flow is effectively set up in the cooling liquid by the guide ribs 18, the flowrate of the cooling liquid flowing through the hollow areas 6 is not increased, and the heat radiation from the hollow areas 6 to the cooling liquid is not affected. A construction wherein column-shaped members are provided in the water jacket is disclosed in Jikkai Sho 56-101442 published by the Japanese Patent Office in 1981. However, this structure is not intended to improve heat radiation but to prevent vibration.

FIGS. 8 and 9 show a third embodiment of this invention. Here, V-shaped guide ribs 20 are joined only to the water jacket wall 4, and gaps 21 are provided between the guide ribs 20 and cylinder walls 2. In this construction, the cylinder walls 2 facing the guide ribs 20 are not overly cooled during casting so that casting of the cylinder block 1 is more easily accomplished.

FIGS. 10 and 11 show a fourth embodiment of this invention, showing a guide rib 27 in a plug 26 for sealing a slag hole 25 provided in the wall 4 of the water jacket 3.

According to this embodiment, the guide ribs 27 can be provided without making any modification to the insert used for forming the water jacket 3.

FIGS. 12–14 show a fifth embodiment of this invention. Guide ribs 30 shown in this embodiment have a shape wherein the upstream edge of the guide ribs 10 in the first embodiment of FIGS. 1–4, has been cut away. In other words, the guide ribs 30 consist of an upper side 32 which is inclined in an upward direction and a lower side 33 inclined in a downward direction. The guide ribs 30 are disposed symmetrically while retaining an opening 31 in the upstream edge. The upper side 32 and lower side 33 are joined to both the cylinder wall 2 and the wall 4 of the water jacket 3, and are cast in a one-piece construction with the cylinder block 1.

According to this embodiment, cooling liquid flows through the opening 31 in the center part of the guide rib 30, so there is less change in the cross-sectional flow area of the water jacket 3. In other words, as shown in FIG. 14, the width of the flowpath of the water jacket 3 is reduced by the width of the upper side guide rib 32 and lower side guide rib 33, compared to the width $A_1$ where the guide ribs 30 are not provided. The width at the upstream end is $A_2+A_3+A_4$, while at the downstream end it is $A_5+A_6+A_7$, both of which are not substantially different from $A_1$. Hence, there is not much change in the cross-sectional area of the flowpath of the water jacket 3, and the resistance to the flow of cooling liquid is kept to a minimum.

FIG. 15 shows a sixth embodiment of this invention using guide ribs 40 formed by bending the upper side 42 and lower side 43 into a bow shape. According to this embodiment, the cooling liquid has a stronger flowrate component in the vertical direction along the upper side guide rib 42 and the lower side guide rib 43 as shown by the arrow in the figure. A strong whirlpool effect is therefore produced behind the guide ribs 40, which is in the vicinity of the hollow areas 6.

The embodiments of this invention in which an exclusive property or privilege is claimed are defined as follows.

We claim:

1. A liquid-cooled engine cylinder block comprising:

a plurality of cylinders arranged in series, said cylinders being formed by cylinder walls wherein adjacent cylinder walls are joined together, and a water jacket formed by a water jacket wall covering the outer circumference of said cylinder walls such that a passage for cooling liquid is formed by said water jacket wall and said cylinder walls in a direction perpendicular to the axes of said cylinders, wherein said cylinder block further comprises a guide rib provided adjacent to said outer circumference of said cylinder walls and inside said passage so as to vertically separate a flow of said cooling liquid, said guide rib comprising two guide members extending in respective upward and downward directions from the upstream ends of said guide members which are located in a substantially central position in the vertical width of said passage.

2. A liquid-cooled engine cylinder block as defined in claim 1, wherein said guide rib has a "V" shape, the apex being formed by the upstream ends of said guide members.

3. A liquid-cooled engine cylinder block as defined in claim 1, wherein said guide rib has an arc shape, the center of said arc being formed by the upstream ends of said guide members.

4. A liquid-cooled engine cylinder block as defined in claim 1, wherein said guide rib is formed in a one-piece construction with said water jacket wall, and a gap exists between said guide rib and said cylinder wall.

5. A liquid-cooled engine cylinder block as defined in claim 1, wherein an opening through which cooling fluid can pass is provided between the upstream ends of said guide members.

6. A liquid-cooled engine cylinder block as defined in claim 1, wherein said guide members are bent into a bow shape in the upward and downward directions.

7. A liquid-cooled engine cylinder block as defined in claim 1, wherein said cylinder block is formed by casting, a slag hole is provided in said water jacket wall, and said guide rib is formed in a one-piece construction with a plug sealing said hole.

* * * * *